US006491547B1

(12) United States Patent
Chen

(10) Patent No.: US 6,491,547 B1
(45) Date of Patent: Dec. 10, 2002

(54) SIGNAL-TRANSMITTING APPARATUS WITH AN ELECTROMAGNETIC RADIATION SHIELDING ASSEMBLY

(75) Inventor: Lloyd Chen, Chung-Ho (TW)

(73) Assignee: Taiwan Cable Connection Corp., Taiepei Hsien (TW)

( * ) Notice: Subject to any disclaimer, the term of this patent is extended or adjusted under 35 U.S.C. 154(b) by 0 days.

(21) Appl. No.: 10/037,030

(22) Filed: Jan. 3, 2002

(30) Foreign Application Priority Data

Oct. 16, 2001 (TW) ..... 090217629 A

(51) Int. Cl.[7] ..... H01R 13/66
(52) U.S. Cl. ..... 439/620; 439/76.1
(58) Field of Search ..... 439/620, 76.1, 439/607

(56) References Cited

U.S. PATENT DOCUMENTS 5,326,280 A * 7/1994 Briones et al. ..... 439/620
5,413,504 A * 5/1995 Kloecker et al. ..... 439/620
5,622,524 A * 4/1997 Dirmeyer ..... 430/620
6,036,545 A * 3/2000 Caviness et al. ..... 439/620
6,152,743 A * 11/2000 Fox ..... 439/620
6,380,826 B1 * 4/2002 Palinkas ..... 439/620

* cited by examiner

*Primary Examiner*—Gary Paumen
(74) *Attorney, Agent, or Firm*—Merchant & Gould P.C.

(57) ABSTRACT

In a signal-transmitting apparatus for a cable television system, a capacitor unit is disposed in a power source-connecting tube integrally formed with a side wall of a metal casing, and is received fittingly within a capacitor-mounting hole in the side wall. A conductive terminal clip is disposed within the power source-connecting tube, and has a clamping end adapted to clamp a power source terminal, and a conducting end in electrical connection with the capacitor unit.

10 Claims, 5 Drawing Sheets

SIGNAL-TRANSMITTING APPARATUS WITH AN ELECTROMAGNETIC RADIATION SHIELDING ASSEMBLY

CROSS-REFERENCE TO RELATED APPLICATION

This application claims priority of Taiwan Patent Application No. 90217629, filed on Oct. 16, 2001.

BACKGROUND OF THE INVENTION

1. Field of the Invention

The invention relates to a signal-transmitting apparatus, more particularly to a signal-transmitting apparatus for a cable television system that is provided with an electromagnetic radiation shielding assembly which is space-saving.

2. Description of the Related Art

A conventional signal-transmitting apparatus, such as an amplifier, a distributor, or a diverter, for use in a cable television system requires a power source-connecting tube for receiving a power source terminal so as to connect to an electric power supply for supplying operating power to electronic components in the apparatus. However, when electric currents flow through the apparatus, if no shielding means is provided, the electromagnetic radiation thus generated will interfere with the operation of the electronic components within the apparatus or the input/output ports, thereby adversely affecting the quality of signal transmission.

FIGS. 1 and 2 show a conventional signal-transmitting apparatus with an electromagnetic radiation shielding member which is adapted for use in a conventional cable television system. The apparatus, which is exemplified herein using an amplifier, includes a casing 90 having a metal first partition 91 disposed near a corner of the casing 90 and confining a corner space, a metal top cover 92 disposed on top of the first partition 91 to close the corner space, a metal second partition 93 disposed within the corner space and having a top edge formed with an indentation 931, and a capacitor 94 disposed in the indentation 931. The capacitor 94 includes a main body 942, and opposite outer and inner contact pins 941, 943. The outer contact pin 941 is soldered to an inner end of a power source terminal 96 extending through a power source-connecting tube 95. The main body 942 is mounted in the indentation 931, and is connected electrically to the top cover 92 so as to constitute a grounding circuit when the top cover 92 is put in place. The inner contact pin 943 is connected electrically to a contact on a circuit board 98 disposed within the corner space via a lead wire 97.

Although the first and second partitions 91, 93 and the top cover 92 together can serve to shield the electromagnetic radiation generated by the terminal 96 during operation, the first and second partitions 91, 93 occupy a relatively large amount of the space available in the casing 90. Hence, the overall size of the apparatus cannot be reduced. Besides, if the top cover 92 is not in sealing contact with the top edge of the second partition 93, the electromagnetic radiation from the terminal 96 may still escape through a clearance between the top cover 92 and the second partition 93.

SUMMARY OF THE INVENTION

Therefore, the main object of the present invention is to provide a signal-transmitting apparatus with an electromagnetic radiation shielding assembly that utilizes a power source-connecting tube of the apparatus to serve as an electromagnetic radiation shielding member to thereby enable a reduction in the size of the apparatus.

Accordingly, a signal-transmitting apparatus for a cable television system of the present invention is adapted to permit insertion of a power source terminal therein and includes:

a body including a metal casing and a circuit board that is fixed in the casing, the casing having a side wall with a capacitor-mounting hole, and a power source-connecting tube which is formed integrally with the side wall at an end thereof and which defines a central hole that is in communication with the capacitor-mounting hole in the side wall;

a conductive terminal clip disposed within the central hole in the power source-connecting tube, the clip having a clamping end that is adapted to clamp the terminal, and a conducting end; and a capacitor unit disposed in the central hole in the power source-connecting tube and received fittingly within the capacitor-mounting hole in the side wall, the capacitor unit including a capacitor, which has a main body in electrical connection with the casing, an outer contact pin in electrical connection with the conducting end of the clip, and an inner contact pin in electrical connection with the circuit board.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
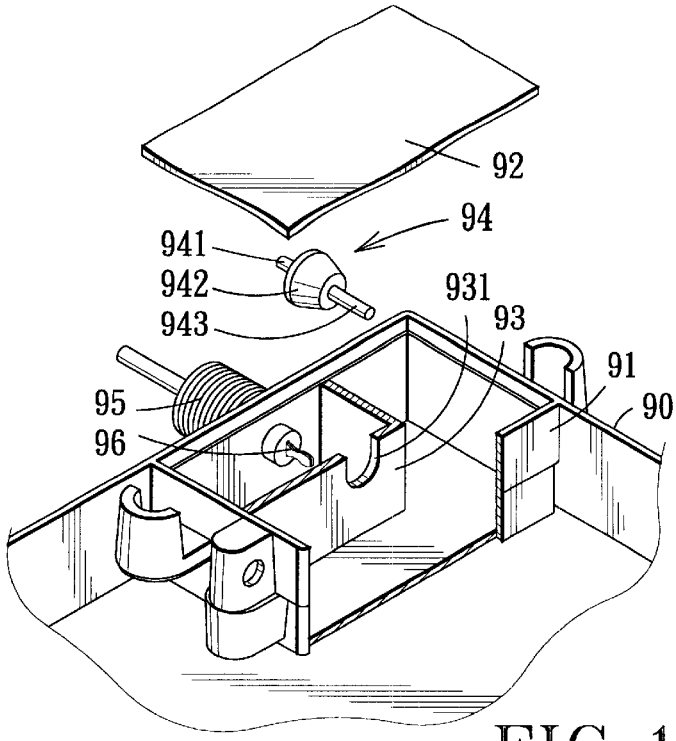
FIG. 1 PRIOR ART
FIG. 1 is a fragmentary partly exploded perspective view of a conventional signal-transmitting apparatus having an electromagnetic radiation shielding member, with a partition cut away for the sake of brevity.
Figure 2:
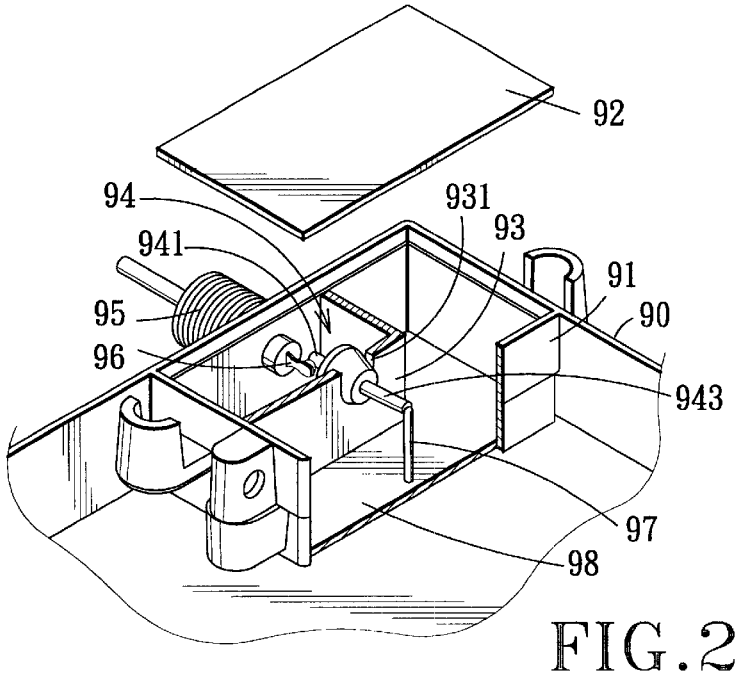
FIG. 2 PRIOR ART
FIG. 2 is another fragmentary partly exploded perspective view of the conventional signal-transmitting apparatus.
Figure 3:
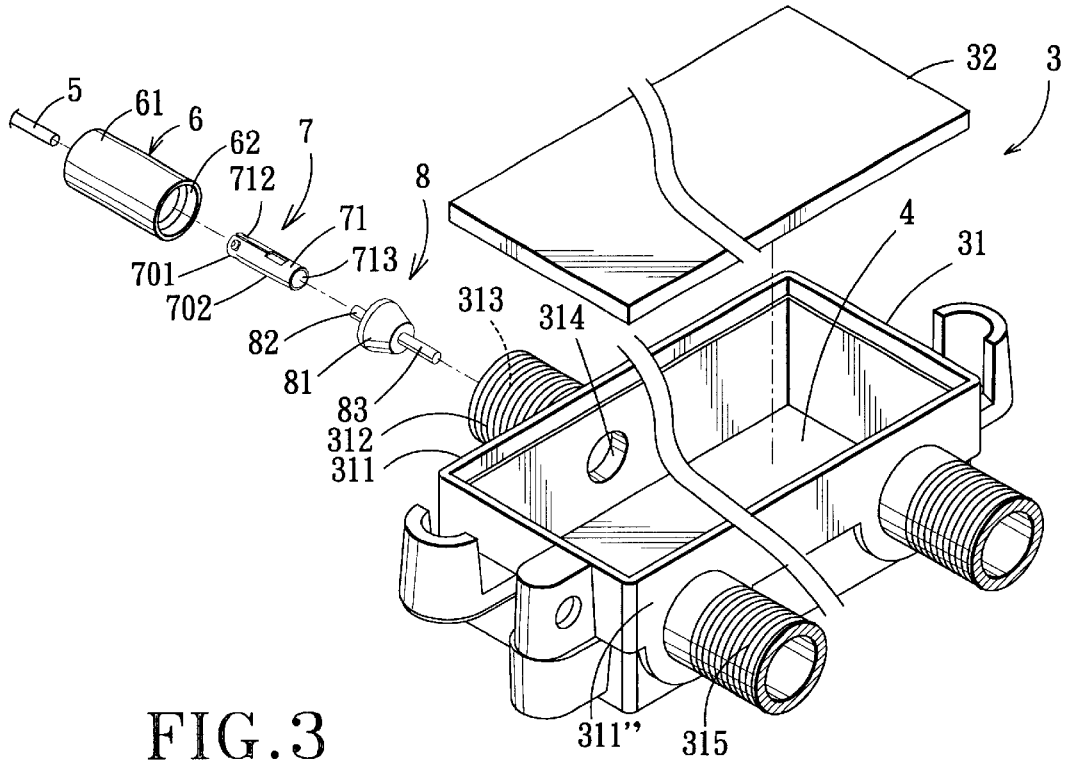
FIG. 3 is an exploded perspective view of a first preferred embodiment of a signal-transmitting apparatus with an electromagnetic radiation shielding assembly according to the invention.

Referring to FIGS. 3 to 6, the first preferred embodiment of a signal-transmitting apparatus for a cable television system according to the present invention is exemplified using an amplifier and is adapted to permit insertion of a power source terminal 5 therein. As shown, the signal-transmitting apparatus includes a body 3, a conductive terminal clip 7 and a capacitor unit. The body 3 comprises a generally rectangular metal casing which includes a casing body 31 that has an open top end, and a top cover 32 that is press-fitted within the top end, and a circuit board 4 that is fixed in the casing body 31. The casing body 31 has a side wall 311 with a capacitor-mounting hole 314, and a power source-connecting tube 312 which is formed integrally with the side wall 311 at an end thereof and which defines a central hole 313 that is in communication with the capacitor-mounting hole 314 in the side wall 311. The casing body 31 further has another side wall 311" that is opposite to the side wall 311 and that is formed with a plurality of signal terminal connecting tubes 315 adapted to connect with a plurality of signal terminals (not shown) for signal transmission.

The clip 7 is disposed within the central hole 313 in the power source-connecting tube 312, and has a clamping end 701 that is adapted to clamp the terminal 5, and a conducting end 702. The clip 7 has a generally cylindrical metal surrounding wall 71 confining a terminal clamping space 72 and including a clamping portion 711 which is disposed proximate to the clamping end 701 and which is dented inwardly in radial directions so as to be adapted to press against the terminal 5 when the latter is inserted into the clamping space 72. The surrounding wall 71 is further provided with a plurality of open-ended axial slots 712 so as to attribute to the axial flexibility of the clamping portion 711. A convex connecting portion 713 is disposed at the conducting end 702 opposite to the clamping end 701.

The capacitor unit is disposed in the central hole 313 in the power source-connecting tube 312, and is received fittingly within the capacitor-mounting hole 314 in the side wall 311. The capacitor unit includes a capacitor 8, which has a main body 81 in electrical connection with the casing body 31 of the casing, an outer contact pin 82 in electrical connection with the connecting portion 713 at the conducting end 702 of the clip 7, and an inner contact pin 83 opposite to the outer contact pin 82 and in electrical connection with the circuit board 4 via a lead wire 85. The main body 81 is received fixedly and fittingly within and extends through the capacitor-mounting hole 314 in the side wall 311 of the casing body 31. In this embodiment, the main body 81 has an inner portion 810 which is disposed proximate to the inner contact pin 83 and which is shaped as a truncated cone. In order to receive the main body 81 fittingly, the capacitor-mounting hole 314 in this embodiment is also shaped as a truncated cone, and has an inner end 316, an outer end 317, and a diameter that increases gradually from the inner end 316 to the outer end 317. As such, after the capacitor 8 is fitted into the capacitor-mounting hole 314 via the outer end 317, the main body 81 will project partially from the inner end 316, and will be prevented from slipping from the capacitor-mounting hole 314 into the casing body 31. Furthermore, the inner and outer contact pins 83, 82 are integrally formed with each other so as to constitute a positive pole of the capacitor 8, and the main body 81 which is disposed fittingly in the capacitor-mounting hole 314 in the side wall 311 serves as a negative pole of the capacitor 8, thereby forming a grounding circuit. As such, electromagnetic radiation which is generated during operation can be shielded.

Figure 6:
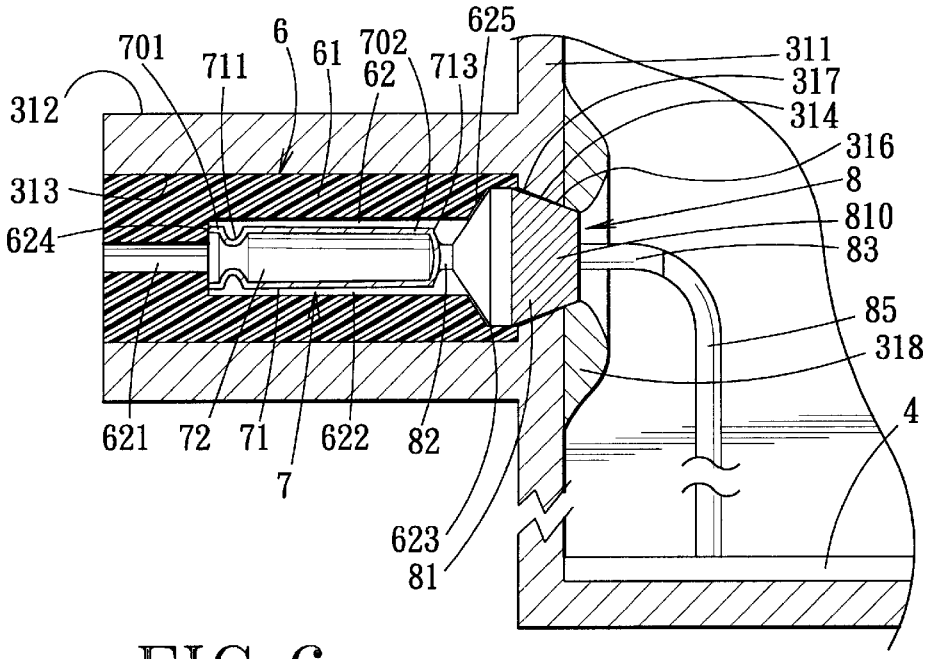
FIG. 6 is a sectional view of the first preferred embodiment taken along line VI—VI of FIG. 5.
Figure 7:
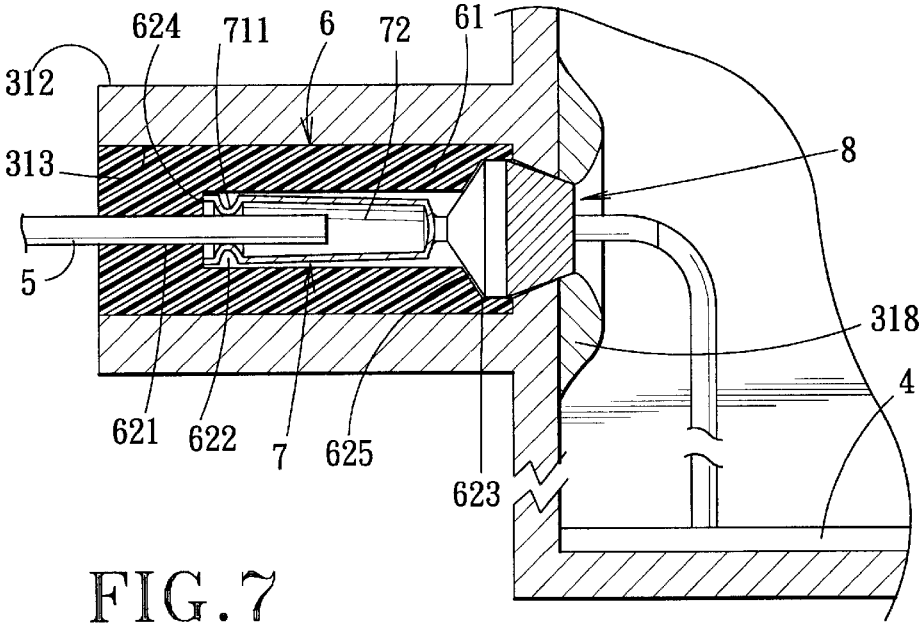
FIG. 7 is a view similar to FIG. 6, with a power source terminal inserted therein.

The signal-transmitting apparatus further includes an insulating sleeve 6, which is disposed within the central hole 313 in the power source-connecting tube 312 and which is adapted to be sleeved on the terminal 5, the clip 7 and the capacitor 8. Referring to FIGS. 6 and 7, the insulating sleeve 6 has a cylindrical surrounding wall 61 confining a center hole 62, which has: a terminal-receiving end 621 adapted to permit extension of the terminal 5 therethrough; a capacitor-receiving end 623 for receiving the main body 81 of the capacitor 8 therein; and a clip-receiving portion 622 having a diameter that is larger than that of the terminal-receiving end 621 and that is smaller than that of the capacitor-receiving end 623 so as to define an outer shoulder 624 between the terminal-receiving end 621 and the clip-receiving portion 622 and an inner shoulder 625 between the clip-receiving portion 622 and the capacitor-receiving end 623. As such, when the insulating sleeve 6 is sleeved on the capacitor 8 and the clip 7, the clamping end 701 of the clip 7 abuts against the outer shoulder 624, while the main body 81 of the capacitor 8 abuts against the inner shoulder 625.

Figure 4:
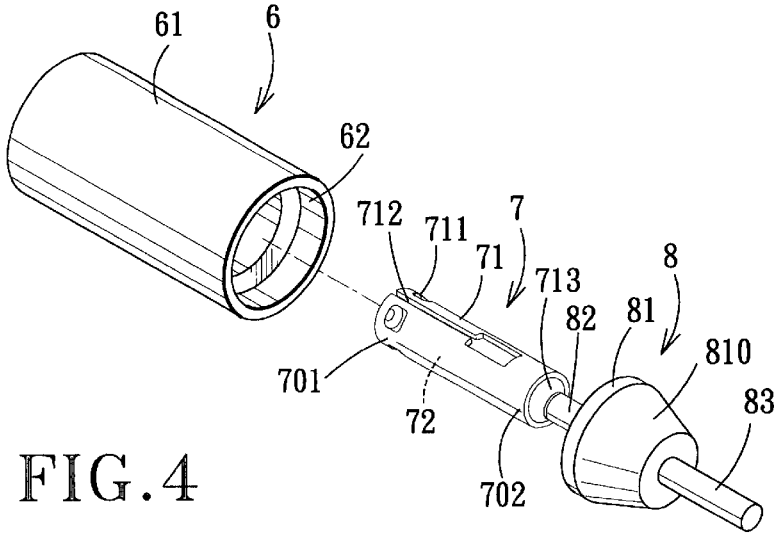
FIG. 4 is a partly exploded perspective view showing an insulating sleeve, and a capacitor soldered to a conductive terminal clip of the first preferred embodiment.
Figure 5:
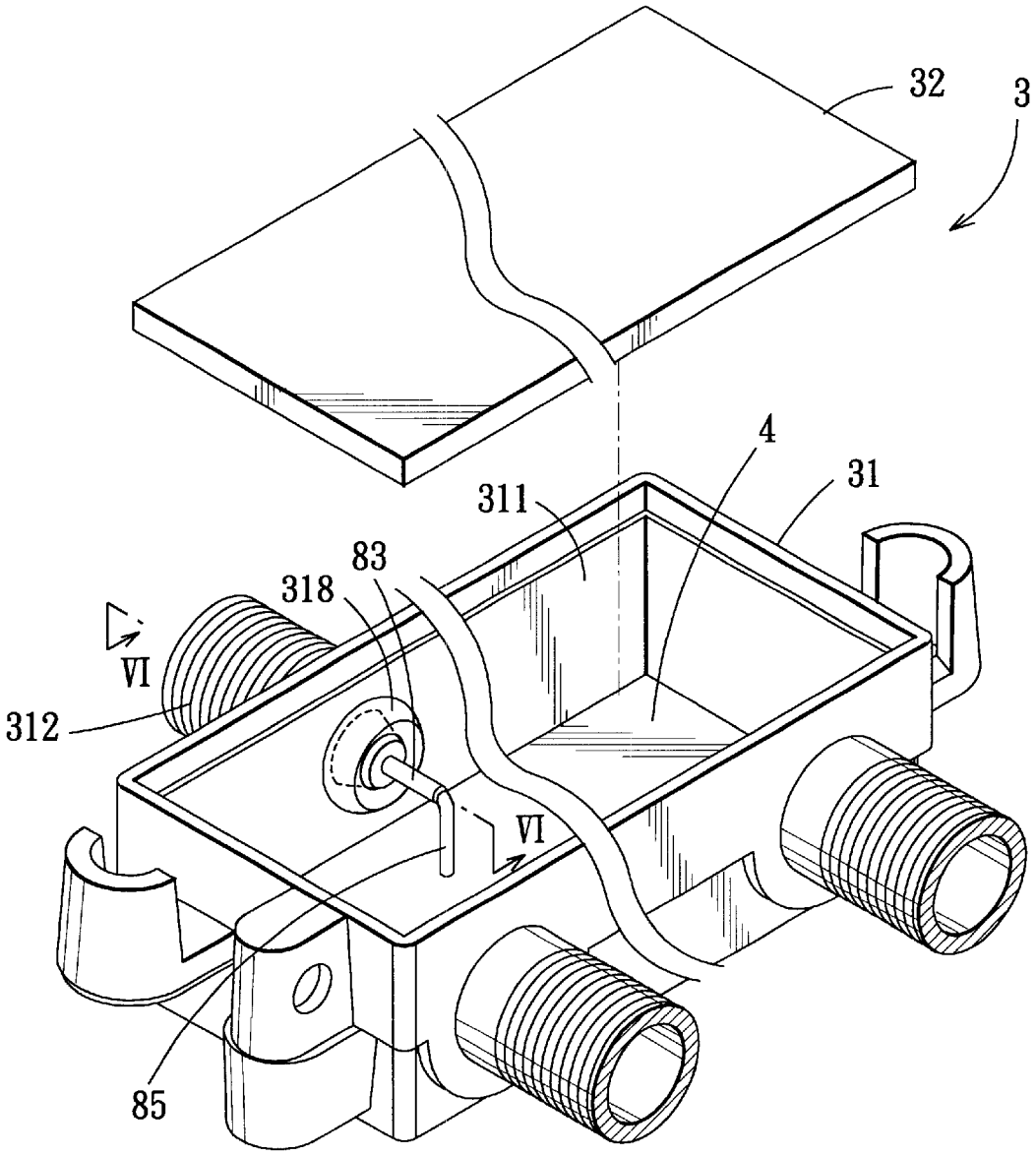
FIG. 5 is a perspective view of the first preferred embodiment in a partly assembled state.

Referring to FIG. 4, during assembly, the connecting portion 713 at the conducting end 702 of the clip 7 and the outer contact pin 82 of the capacitor 8 are first soldered together. Then, both the clip 7 and the capacitor 8 are inserted into the center hole 62 in the insulating sleeve 6 at corresponding positions. Subsequently, with reference to FIGS. 5 and 6, the insulating sleeve 6 is inserted into the power source-connecting tube 312 such that the main body 81 extends through the capacitor-mounting hole 314, and the inner portion 810 thereof projects from the inner end 316 of the capacitor-mounting hole 314. Tin solder is then applied between the side wall 311 surrounding the capacitor-mounting hole 314 and the portion of the inner portion 810 such that a solder joint 318 formed thereat is connected fixedly to the side wall 311, and is disposed fixedly around the main body 81 of the capacitor 8, thereby establishing an air-tight seal therebetween. Next, ends of the lead wire 85 are respectively soldered to the inner contact pin 83 and a contact on the circuit board 4. Thereafter, the terminal 5 (see FIG. 7) is inserted into the terminal receiving space 72 of the clip 7 via the clamping end 701, and is clamped by the clamping portion 711, which in turn is caused to flex radially and outwardly, thereby establishing electrical connection between the terminal 5 and the clip 7.

Figure 8:
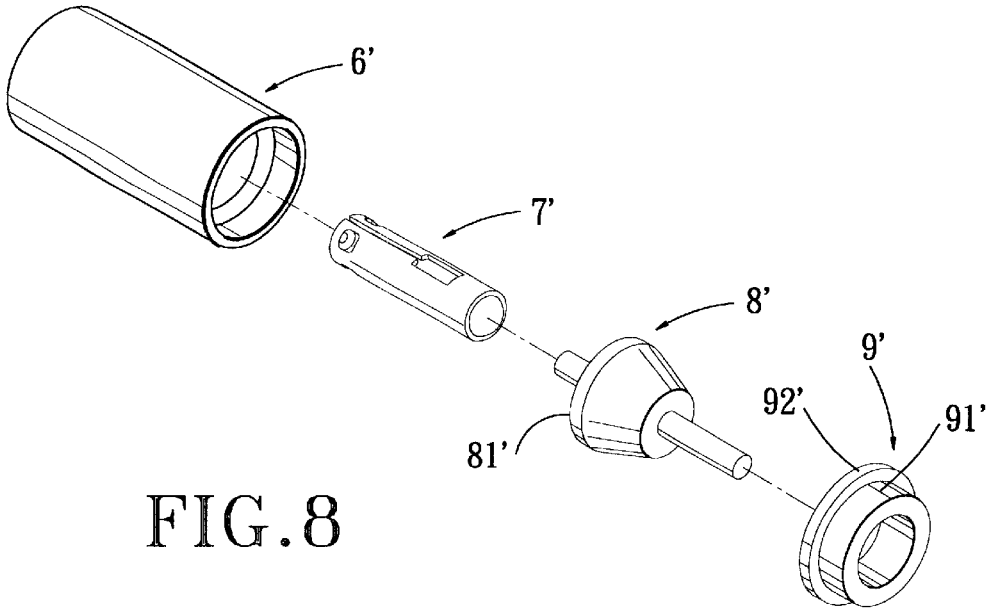
FIG. 8 is an exploded perspective view showing a capacitor unit, a conductive terminal clip and an insulating sleeve of a second preferred embodiment of a signal-transmitting apparatus according to the present invention.
Figure 9:
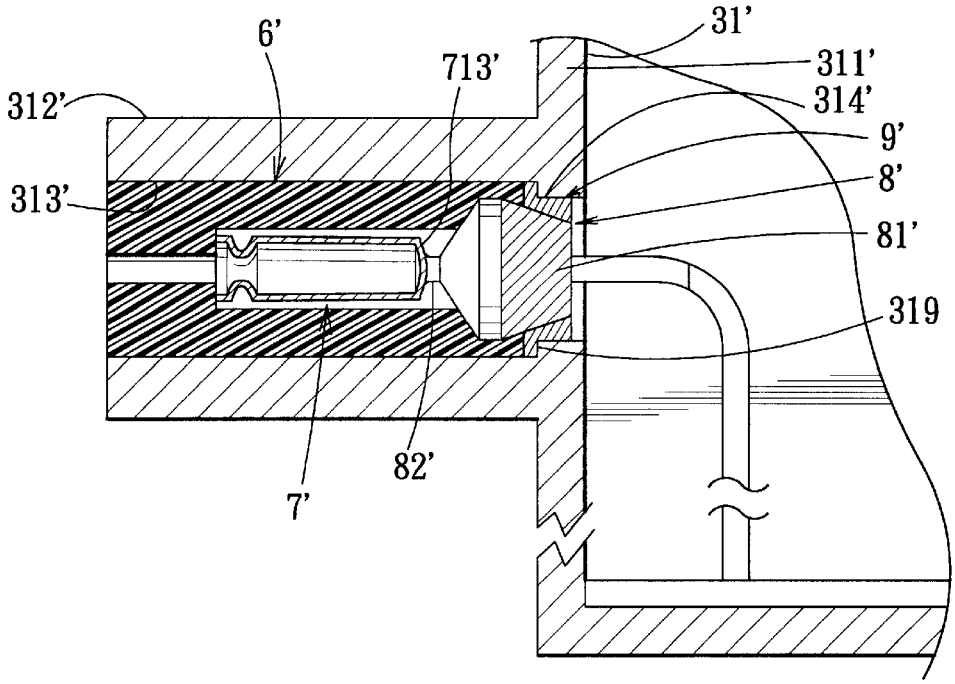
FIG. 9 is a partly sectional fragmentary view of the second preferred embodiment in an assembled state.

FIGS. 8 and 9 show another preferred embodiment of the signal-transmitting apparatus according to the present invention. In this embodiment, a casing body 31' has a side wall 311' formed with a capacitor-mounting hole 314' and a power source-connecting tube 312' formed with a central hole 313'. A shoulder 319 is defined between the central hole 313' and the capacitor-mounting hole 314'. Furthermore, the capacitor unit further includes a metal ring 9', which is sleeved fixedly on a main body 81' of a capacitor 8' and which is press-fitted within the capacitor-mounting hole 314', thereby facilitating electrical connection between the capacitor 8' and the casing body 31'. The ring 9' has a ring body 91', and is formed with an integral flange 92' that extends radially and outwardly from an outer end of the ring body 91' and that abuts against the shoulder 319, thereby positioning the ring 9' relative to the side wall 311'. During assembly, an outer contact pin 82' of the capacitor 8' is soldered to a connecting portion 713' of a terminal clip 7'. The metal ring 9' is sleeved on an inner portion of the main body 81' and is fixed thereon via soldering. The capacitor unit is then inserted into an insulating sleeve 6' and is further inserted into the central hole 313' such that the flange 92' abuts against the shoulder 319, whereby the main body 81', the metal ring 9' and the side wall 311' constitute a grounding circuit.

Referring to FIGS. 7 and 8, as compared to the aforesaid prior art, the present invention, which utilizes the power source-connecting tube 312, 312' to shield the electromagnetic radiation generated by the terminal 5 disposed therein has advantages of space-saving and compactness. Moreover, the arrangement of the solder joint 318 or the ring 9' in the preferred embodiments can further ensure that the electromagnetic radiation from the terminal 5 can be contained within the power source-connecting tube 312, 312' to thereby enhance the quality of signal transmission.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A signal-transmitting apparatus for a cable television system, said signal-transmitting apparatus being adapted to permit insertion of a power source terminal therein and comprising:

a body including a metal casing and a circuit board that is fixed in said casing, said casing having a side wall with a capacitor-mounting hole, and a power source-connecting tube which is formed integrally with said side wall at an end thereof and which defines a central hole that is in communication with said capacitor-mounting hole in said side wall;

a conductive terminal clip disposed within said central hole in said power source-connecting tube, said clip having a clamping end that is adapted to clamp the terminal, and a conducting end; and a capacitor unit disposed in said central hole in said power source-connecting tube and received fittingly within said capacitor-mounting hole in said side wall, said capacitor unit including a capacitor, which has a main body in electrical connection with said casing, an outer contact pin in electrical connection with said conducting end of said clip, and an inner contact pin in electrical connection with said circuit board.

2. The signal-transmitting apparatus as claimed in claim 1, wherein said casing includes a casing body that receives said circuit board therein and that has an open top end, and a top cover that is press-fitted within said top end of said casing body.

3. The signal-transmitting apparatus as claimed in claim 1, further comprising an insulating sleeve, which is disposed within said central hole in said power source-connecting tube and which is adapted to be sleeved on the terminal, said clip and said capacitor.

4. The signal-transmitting apparatus as claimed in claim 3, wherein said insulating sleeve is formed with a center hole therethrough, said center hole having:

a terminal-receiving end adapted to permit extension of the terminal therethrough;

a capacitor-receiving end for receiving said capacitor unit therein; and a clip-receiving portion having a diameter that is larger than that of said terminal-receiving end and that is smaller than that of said capacitor-receiving end so as to define an outer shoulder between said terminal-receiving end and said clip-receiving portion and an inner shoulder between said clip-receiving portion and said capacitor-receiving end, said clamping end of said clip abutting against said outer shoulder, said main body of said capacitor abutting against said inner shoulder.

5. The signal-transmitting apparatus as claimed in claim 1, wherein said main body of said capacitor is received fixedly and fittingly within said capacitor-mounting hole in said side wall of said casing.

6. The signal-transmitting apparatus as claimed in claim 5, wherein said main body of said capacitor extends through said capacitor-mounting hole in said side wall of said casing.

7. The signal-transmitting apparatus as claimed in claim 6, further comprising a solder joint, which is connected fixedly to said side wall and which is disposed fixedly around said main body of said capacitor, thereby establishing an air-tight seal therebetween.

8. The signal-transmitting apparatus as claimed in claim 6, wherein said capacitor-mounting hole in said side wall is shaped as a truncated cone, and has an inner end, an outer end, and a diameter that increases gradually from said inner end to said outer end.

9. The signal-transmitting apparatus as claimed in claim 1, wherein said capacitor unit further includes a metal ring, which is sleeved fixedly on said main body of said capacitor and which is press-fitted within said capacitor-mounting hole in said side wall, thereby facilitating electrical connection between said capacitor and said casing.

10. The signal-transmitting apparatus as claimed in claim 9, wherein a shoulder is defined between said central hole in said power source-connecting tube and said capacitor-mounting hole in said side wall, said ring being formed with an integral flange that extends radially and outwardly from an end thereof and that abuts against said shoulder, thereby positioning said ring relative to said side wall.

* * * * *